US009637949B2

(12) United States Patent
Niegeloh et al.

(10) Patent No.: US 9,637,949 B2
(45) Date of Patent: May 2, 2017

(54) DOOR HANDLE ARRANGEMENT FOR A MOTOR VEHICLE

(71) Applicants: Andreas Niegeloh, Solingen (DE); Markus Bartels, Mulheim (DE)

(72) Inventors: Andreas Niegeloh, Solingen (DE); Markus Bartels, Mulheim (DE)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 193 days.

(21) Appl. No.: 14/306,962

(22) Filed: Jun. 17, 2014

(65) Prior Publication Data

US 2014/0375068 A1 Dec. 25, 2014

(30) Foreign Application Priority Data

Jun. 25, 2013 (DE) ..... 10 2013 106 618

(51) Int. Cl.

| | |
|---|---|
| ***E05B 3/00*** | (2006.01) |
| ***E05B 7/00*** | (2006.01) |
| ***E05B 77/06*** | (2014.01) |
| ***E05B 85/16*** | (2014.01) |

(52) U.S. Cl.

CPC ..... *E05B 7/00* (2013.01); *E05B 77/06* (2013.01); *E05B 85/16* (2013.01); *Y10T 292/57* (2015.04)

(58) Field of Classification Search

USPC ..... 292/336.3, DIG. 22

See application file for complete search history.

(56) References Cited

U.S. PATENT DOCUMENTS

| | | | | |
|---|---|---|---|---|
| 8,814,232 | B2 * | 8/2014 | Bertolotti | E05B 77/06 292/336.3 |
| 2010/0225127 | A1 * | 9/2010 | Muller | E05B 85/16 292/336.3 |

FOREIGN PATENT DOCUMENTS

| | | | |
|---|---|---|---|
| DE | 10 2008 062213 | A1 | 6/2010 |
| EP | 2 138 656 | A2 | 12/2009 |
| WO | WO 2012/065938 | A1 | 5/2012 |

OTHER PUBLICATIONS

European Search Report of related application EP 14170325, dated Jun. 23, 2015, 5 pages.

* cited by examiner

*Primary Examiner* — Mark Williams
(74) *Attorney, Agent, or Firm* — Fay Sharpe LLP

(57) ABSTRACT

A door handle arrangement for a motor vehicle includes a handle support, a handle, a coupling device, a locking device and a retaining element. When an accelerating force is applied in a first direction, as a result of a motor vehicle accident, the retaining element moves from a basic position in which it is possible to actuate the handle into a direction of blockage in which an actuation of the locking system by the handle and/or the coupling device is blocked. The locking device reliably and securely blocks the handle or the coupling device in the event of a collision. This is achieved in that the retaining element is designed to move from the basic position into the particular direction of blockage when an accelerating force resulting from a motor vehicle accident is applied in a second direction that is opposite of the first direction.

11 Claims, 8 Drawing Sheets

DOOR HANDLE ARRANGEMENT FOR A MOTOR VEHICLE

BACKGROUND

The invention relates to a door handle arrangement for a motor vehicle with a frame-like handle support and a manually actuated handle, which is pivotally mounted at the handle support so that a user is able to open a door or flap of the motor vehicle; it further relates to a coupling device that is swivel-mounted at the handle support, by means of which coupling device a movement of the handle can be transferred to an on-board locking system and a locking device with a retaining element, which is movably attached to the handle support and used as a mass lock, wherein the retaining element is designed in such a way that on impact of an accelerating force resulting from a motor vehicle accident it can be moved from a basic position in which the handle can be actuated to a direction of blockage in which the handle and/or the coupling device is impeded from actuating the locking system.

Such door handle arrangements with a locking device used as a mass lock are to prevent that the accelerating forces occurring during an accident result in actuating the handle or door handle and inadvertently opening the door of the motor vehicle, which would present considerable risks for a passenger of the vehicle. In customarily used door handle arrangements for motor vehicles the handle components to be actuated by the user are mechanically coupled with an on-board locking system (the actual door lock). The movement of the door handle, or handle, is transferred to the locking system by the coupling device and the door is released for opening. In the event of an accident under unfavorable circumstances accelerating forces act as if the handle component is actuated by a user because as a result of inertia the handle can be accelerated in opening direction. When a handle or door handle does not have a respective locking device, the movement of the handle component in relation to the vehicle would result in a transfer by the mechanical coupling device on the locking system in the vehicle and a release of the door. An exemplary scenario for such situations is usually a lateral collision on an obstacle or a different vehicle. Such a locking device used as a mass lock, which is also called a crash stop, is known from prior art.

For example, DE 199 29 022 C2 describes a respective mass lock in the form of a swivel-mounted blocking element which in the event of a collision should rule out an actuation of the door handle. In the event of an accident, forces are exerted on the blocking element, and an inadvertent movement of the handle, also resulting from the applied forces, is blocked. DE 10 2009 053 553 A1, for example, also discloses a door handle arrangement. In this door handle arrangement, the crash stop applies an additional force on the handle or door handle which should definitely prevent that the handle is inadvertently moved.

For example, a door handle arrangement of the type mentioned at the outset, which has a locking device designed in the form of a crash stop, is known from DE 10 2008 000 098 A1.

Such well-known crash stops can be designed as pendulum mass so that, as a result of the applied force, for example, the crash stop is transferred into the movement path of the handle or the coupling device, thus blocking the handle. In addition, there are crash stops which engage in a blocking position and after being activated and engaged, they can only be deactivated by means of a specific intervention in the door handle unit so that the door handle can be used again in normal mode.

Door handle arrangements known from prior art which have a mass lock or a locking device that does not engage when activated but returns to its basic position involve the danger that, for example, in the event of a lateral collision, alternating accelerating forces occur which result in a fluttering of the door handle arrangement, or a back and forth movement. Because of said fluttering or movement the locking device can be in a position during its pendulum movement in which the handle and/or the coupling device is not blocked, even in the event of a collision or a motor vehicle accident. This is the case because the well-known locking devices are activated only in a relatively small locking rotation or displacement range, which block an actuation of the handle or coupling device designed as a bell crank. Consequently, strong and distinctive vibrations or long-lasting vibrations resulting from an impact of accelerating forces involve the danger that in the case of a back and forth moving or oscillating locking device the displacement range is not long enough to reliably prevent a blockage of the handle or the bell crank. Therefore, in the event of a collision, despite its activation the locking device can accept a position during the oscillation process in which it does not block the handle or the bell crank. Furthermore, the well-known door handle arrangements with crash stop have the disadvantage that they are designed only for accelerating forces directed into the interior of the vehicle. Accelerating forces moving in the opposite direction are not taken into consideration, even though they can also have an effect on an inadvertent actuation of the handle.

BRIEF SUMMARY

Therefore, the invention is based on the objective of providing in a constructively simple and cost-effective manner a door handle arrangement in which the locking device reliably and securely blocks the handle or the coupling device even when alternating accelerating forces occur during a collision.

According to the invention, this objective is achieved in a door handle arrangement of the type mentioned at the outset in that the retaining element is designed to move from a basic position into a direction of blockage when as a result of a motor vehicle accident an accelerating force is applied in a second direction that is opposite of the first direction.

Advantageous and practical embodiments and further developments of the invention are described in the subclaims.

The invention provides a door handle arrangement of a motor vehicle which is characterized by a functional construction and which has a simple and cost-effective structure. An essential part of the invention involves that the locking device is designed in such a way that it can be moved from a basic position only in a single direction of blockage when an accelerating force is applied to the locking device or its retaining element in a first direction or in a direction that is opposite of the first direction. Consequently, in the event of a collision or motor vehicle accident, the retaining element always moves in one particular direction, regardless of the direction in which the accelerating force is applied. As a result, it is prevented that the locking device swings back and overshoots beyond the basic position. For example, this characteristic of the invention-based locking device with its retaining element is of advantage in the event of a collision or motor vehicle accident when as a result of applied accelerating forces distinctive vibrations are prevalent. The invention-based locking device, in which in the event of a collision the retaining element always moves in one particular direction of blockage, has the effect that the handle and/or coupling device are effectively blocked even when the locking device swings back or oscillates during a collision, because the retaining element of the locking device does not move in the direction of the basic position when it swings back but continues to move in the direction of blockage. As a result, the locking device is situated at no time in its basic position when accelerating forces are applied during a motor vehicle accident.

It has been observed that the lifetime of the motor vehicles has increased, often 10 and more years. At the same time, the locking devices are normally not used for long periods of time, because they are used only in exceptional cases, such as a motor vehicle accident. Besides the fact that the locking device is rarely used, it has to be taken into consideration that it can be part of a door handle arrangement of an outer handle which is exposed to weather conditions and corrosion. In the commonly known door handle arrangements in the manner of an outer door handle, it cannot be guaranteed that even after many years the functionality of the (up until then not used) locking device is maintained in the required and perfect manner and the vehicle passengers are provided with optimal protection in the event of a motor vehicle accident. Therefore, it is a further objective of the present invention to ensure the functionality of the door handle arrangement and particularly the retaining element. In the context of the invention, this objective is achieved in that a swivel movement of the coupling device resulting from a manual actuation of the handle causes the retaining element to move in one particular direction of blockage without blocking the handle and/or the coupling device. In other words: the coupling device is designed in such a way that its swivel movement resulting from a manual actuation of the handle causes the retaining element to move in the particular direction of blockage without blocking the handle and/or the coupling device. A normal and thus manual actuation of the handle and the application of an accelerating force result in a rotary motion of the retaining element. During normal actuation, the handle is first manually actuated by the user, wherein the manual actuation of the handle makes sure that the retaining element of the locking device is turned. Each manual actuation of the handle also moves the retaining element, thus ensuring that the pivotally mounted retaining element does not get jammed or even corroded over time as a result of weather conditions. At the same time, it is ensured that during normal actuation of the handle the retaining element does not block the handle. The constant movement of the retaining element makes sure that the locking device maintains its function even during a long lifetime.

When accelerating forces are applied during a motor vehicle accident, the retaining element, the handle and the motion-linked coupling device are simultaneously rotated. Because of different masses of inertia, the impact of accelerating forces results in the fact that the retaining element moves faster than the handle or the coupling device, whereby the retaining element moves earlier into a direction of blockage than the handle so that the retaining element is blocking the deflection of the coupling device and/or the handle.

In order for the locking device to be activated independent of whether the applied accelerating force is directed into the interior of the vehicle or in the opposite direction out of the interior of the vehicle, a further embodiment of the invention provides that the locking device has a first mass element which because of the inertia of its mass can be moved from a basic position to a deflection direction when an accelerating force is applied in the first direction, and a second mass element which because of the inertia of its mass can be moved from a basic position to the same deflection direction as the first mass element when an accelerating force is applied in the second direction. At the same time, both mass elements can have a lever-arm-shaped design, wherein the deflection direction can involve a rotational deflection direction.

In a further embodiment of the invention-based door handle arrangement, it has been provided that the retaining element has a disc-shaped design, wherein each of the two lateral surfaces has at least one projection and the projections are arranged diametrically, and wherein a respective projection is attached to a respective mass element, which is designed and attached in such a way that it presses during movement in deflection direction against the attached projection and pushes together with the retaining element in the particular direction of blockage. Because of the two mass elements, the retaining element moves always into the one particular deflection direction, regardless from which direction the accelerating force is applied. Therefore, even when the door handle arrangement is fluttering, i.e., moving back and forth, the retaining element does not swing back into its basic position and is also not deflected beyond the basic position, ensuring that the coupling device securely blocks the handle. The deflection movement of both mass elements involves a rotary motion and therefore the deflection direction involves a rotational direction.

To make sure that the respective mass element moves only in the required deflection direction, the invention provides that the first mass element and the second mass element in their respective basic positions are attached to a respective movement limitation surface which blocks the first and second mass element from moving against the deflection direction. For example, the respective limitation surface can be part of the handle support, whereas it is also possible to use an alternative embodiment.

To keep the installation space of the locking device as small as possible, it is advantageous to pivotally mount a respective first longitudinal end of the lever-arm shaped mass element on a rotational axis, wherein the retaining element is pivotally mounted by means of the rotational axis on the handle support and on the rotational axis between the first mass element and the second mass element. At the same time, the retaining element can be moved and turned in relation to the mass elements, although the retaining element and the two mass elements are mounted on the same rotational axis.

A structurally especially favorable locking device, which moves when the handle is actuated manually and which blocks a deflection of the handle when during a motor vehicle accident an accelerating force is applied, can be implemented with an embodiment of the invention in which the coupling device is provided with a motion projection which moves down into a slot-shaped recess of the locking device when the coupling device is deflected as a result of a manual actuation of the handle, wherein upon further deflecting actuation of the handle the motion projection is pressed against the wall of the recess and pushes the retaining element into the particular direction of blockage. The movement kinematics of the coupling device that is motion-linked with the handle is used to engage directly to the locking device and to move said coupling device from its basic position in the direction of blockage. Consequently, the locking device is also moved to a certain extent during normal actuation of the handle.

A further embodiment of the invention provides that the slot-shaped recess formed in the disc-shaped retaining element is designed in the form of a radially extending groove into which the motion projection of the coupling device can pivot. This embodiment makes it possible to keep the installation space intended for the locking device small especially when the coupling device is swivel-mounted about a swivel axis at the handle support, wherein the rotational axis of the retaining element is basically aligned parallel to the swivel axis of the coupling device.

The invention is designed to provide the retaining element with at least a radially extending groove, preferably two grooves arranged in diametrical fashion. The two radially extending grooves which are arranged in diametrical fashion are especially advantageous with regard to using the door handle arrangement on both sides of the vehicle. In this way, the locking device only has to be turned by 180° in order to be used on the other side of the vehicle, because for the actuation and deflection of the retaining element the direction of impact of the accelerating forces in the event of a motor vehicle accident is of subordinate significance since the retaining element moves only the one direction of blockage and the two mass element deflect in the same deflection direction.

To prevent the handle form further blockage after accelerating forces have been applied, the invention is advantageously designed in such a way that it provides a mechanical resetting element which has the power to push the retaining element into basic position. Different from commonly known locking devices which lock in the event of a collision as a result of the impact of accelerating forces and which have to be manually released so that the handle can be actuated again, the handle of the invention-based door handle arrangement can be used and actuated even after the impact of accelerating forces because the locking device has returned to its basic position.

It is important to understand that the previously mentioned characteristics, as well as the characteristics described in further detail below, are not restricted to be used in the respectively described combination but also in different combinations or even by themselves, without leaving the scope of the invention. The context of the invention is defined only by the claims.

BRIEF DESCRIPTION OF THE DRAWINGS

Further details, characteristics and advantages of the subject matter of the invention are demonstrated in the subsequent description in conjunction with the drawing which shows an exemplary embodiment of the invention.

It is shown.

DETAILED DESCRIPTION

Figure 1:
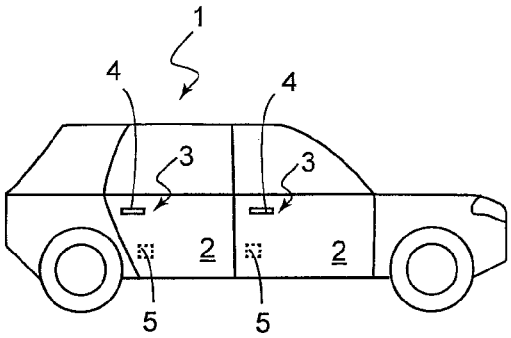
FIG. 1 a lateral view of a motor vehicle with a plurality of invention-based door handle arrangements, FIG. 2 a perspective frontal view on an invention-based door handle arrangement, FIG. 3 a perspective rear view of the door handle arrangement shown in FIG. 2, FIG. 4 a perspective single component view of the door handle arrangement shown in FIGS. 2 and 3, FIG. 5 a perspective view of a coupling device of the door handle arrangement, FIG. 6 a perspective view of a locking device of the door handle arrangement, FIG. 7 a perspective view of the door handle arrangement when the handle is not actuated, FIG. 8 a lateral view of the positions of the coupling device and the locking device when the handle is not actuated, FIG. 9 a perspective view of the door handle arrangement with semi-actuated handle, FIG. 10 a lateral view of the positions of the coupling device and the locking device with semi-actuated handle, FIG. 11 a perspective view of the door handle arrangement when the handle is completely actuated, FIG. 12 a lateral view of the positions of the coupling device and the locking device when the handle is completely actuated, FIG. 13 a perspective view of the door handle arrangement when the locking device is activated as a result of an accelerating force applied to the interior of the vehicle, FIG. 14 a lateral view of the positions of the coupling device and the locking device when the locking device is activated as a result of an accelerating force applied to the interior of the vehicle, FIG. 15 a perspective view of the door handle arrangement when the locking device is activated as a result of an accelerating force directed out of the interior of the vehicle, FIG. 16 a lateral view of the positions of the coupling device and the locking device when the locking is activated as a result of an accelerating force directed out of the interior of the vehicle, FIG. 17 a perspective view of the door handle arrangement with activated locking device and over torqued retaining element, and FIG. 18 a lateral view of the positions of the coupling device and the locking device with activated locking device and over torqued retaining element.

FIG. 1 shows an exemplary diagram of a vehicle or motor vehicle 1 in the form of an automobile, which has 4 doors 2 which can be opened by means of a door handle arrangement 3 and especially by means of a door handle or handle 4. The doors 2 are locked via respective locking systems 5 and can be opened from the outside only via a respective movement of the handle 4. This movement at the handle 4 can comprise a pulling and/or flapping motion, wherein the respective movement of the handle 4 can be transferred mechanically to the respective locking system 5 at least via a coupling device. By moving the handle 4 the respective locking system 5 and thus the associated door 2 can be opened.

Figure 2:
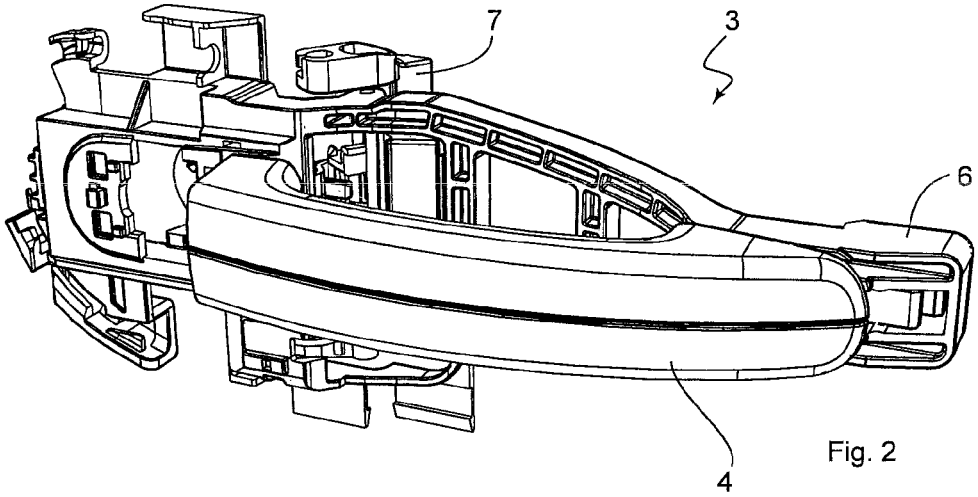
Figure 3:
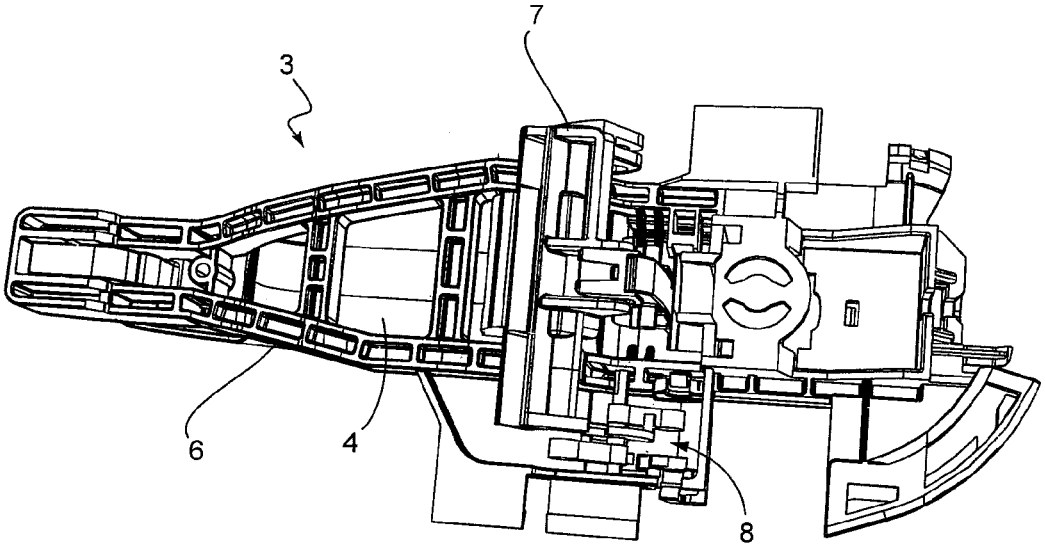
Figure 4:
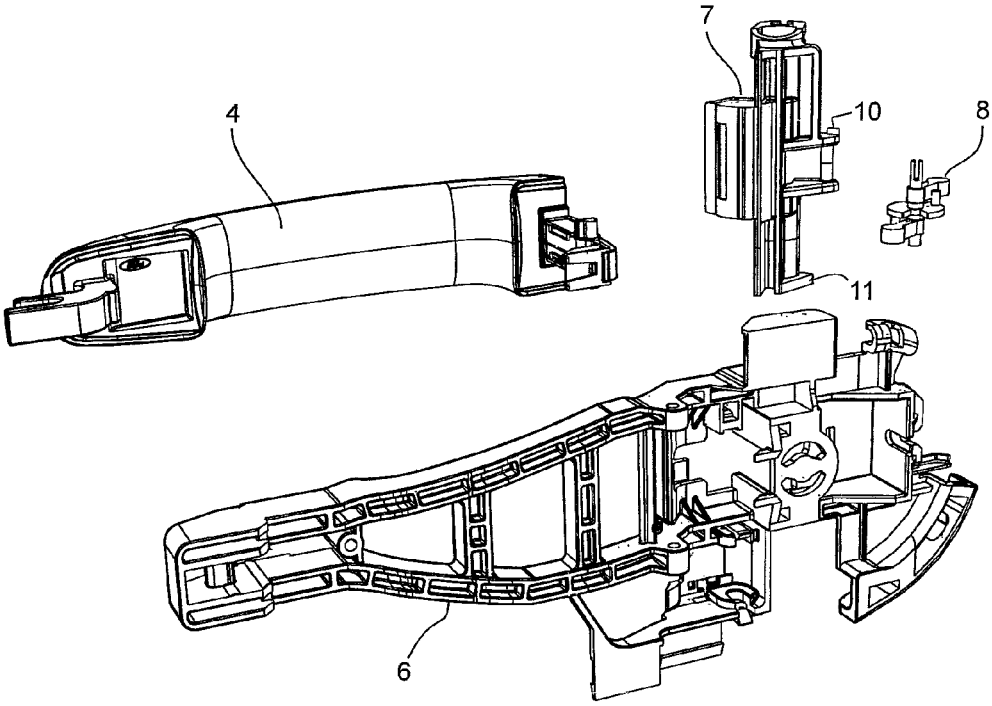

FIGS. 2, 3 and 4, respectively, show a perspective view of the door handle arrangement 3, wherein a frontal view is shown in FIG. 2, a rear view in FIG. 3 and a single component view in FIG. 4. The door handle arrangement 3 has a frame-like handle support 6 which is used in known fashion to attach the handle 4, and which is mounted by means of a screw assembly (not shown) at the interior side of the door panel. The figures show that the handle 4 is arranged on the outer side of the door. At the same time, for the purpose of saving material costs, the handle support 6 mostly consists of a structured framework which has different receiving and storage spaces to be able to accept a mechanical coupling device 7 and a locking device 8 in addition to the handle 4 which is pivotally and/or swivel-mounted at the handle support 6 so that a user can open a respective door 2 of the motor vehicle 1.

By means of the mechanical coupling device 7, a movement of the handle 4 can be transferred to the respective on-board locking system 5 in order to open the respective door 2. The locking device 8 used as mass lock has a retaining element 9 (see FIG. 6) which can change its position from a basic position (see, for example, FIG. 7) to a of blocking position (see, for example, FIGS. 13 and 15) by being moved in a direction of blockage when an accelerating force is applied. In the basic position of the retaining element 9, it is possible to actuate the handle 4, whereas in the blocking position the retaining element 9 of the locking device which is pivotally mounted at the handle support 6 blocks the handle 4 from actuating the locking system 5 and/or from moving the coupling device 7. In particular, the blockage immediately occurs when the retaining element 9 is moved from the basic position into the direction of blockage.

Figure 5:
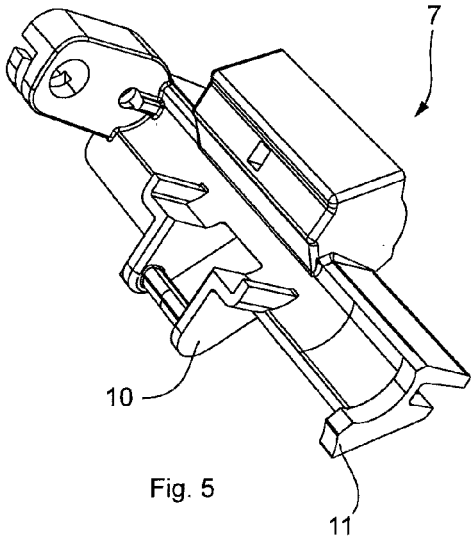
Figure 7:
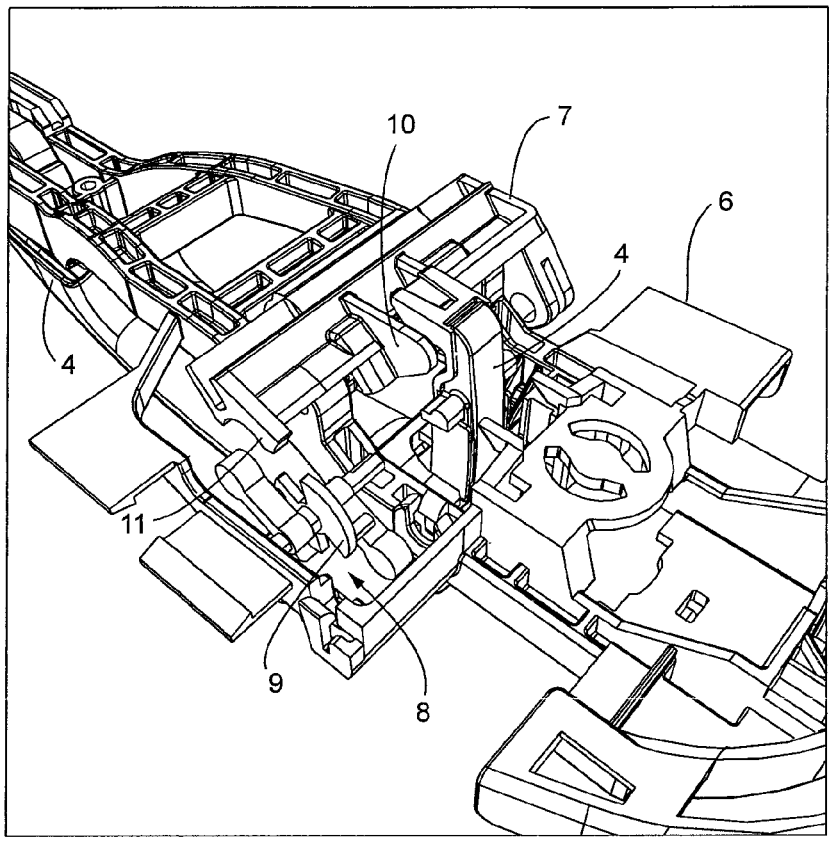

The coupling device 7 is motion-linked with the handle 4 via a protruding bell crank 10, thus transferring a movement of the handle 4 to the coupling device 7, whereby the coupling device 7 is pivoted about an axis (not shown) in relation to the handle support 6. The coupling device 7 is swivel-mounted in a receiving space of the handle support 6, wherein the movement initiated by the handle 4 is transferred from the coupling device 7 via a transmission element (not shown—for example a Bowden cable) to the locking system 5. FIG. 5 or 7 show in an exemplary manner that the coupling device 7 also has a motion projection 11. Together with coupling device 7, the motion projection 11 is pivoted about swivel axis. The free end of the motion projection 11 moves in the direction of the locking device 8 and interacts with the locking device 8 when the coupling device 7 is pivoted either as a result of a manual actuation of the handle 4 or as a result of a motor vehicle accident.

Figure 6:
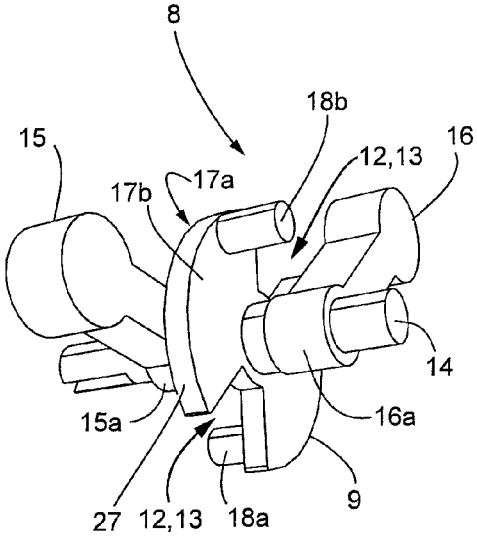

FIG. 6 provides a detailed view of the locking device 8. The locking device 8 comprises a retaining element 9 which has a disc-shaped design and which comprises a slot-shaped recess 12. The slot-shaped recess 12 is designed as a radial groove 13 which extends radially to the outside in the disc-shaped retaining element 9. As a result, the motion projection 11 of the coupling device 7 is able to pivot into the groove 13 when the retaining element 9 is situated in basic position (see, for example, FIG. 8). The figures show that the retaining element 9 has two radially extending grooves 13 which are arranged in diametrical fashion and which allow the locking device 8 to be used on both sides of the vehicle. By means of a rotational axis 14, the center of the retaining element 9 of the locking device 8 is pivotally mounted at the handle support 6, so that the movement of the locking device 9 from basic position to a direction of blockage becomes a rotary motion.

Figure 8:
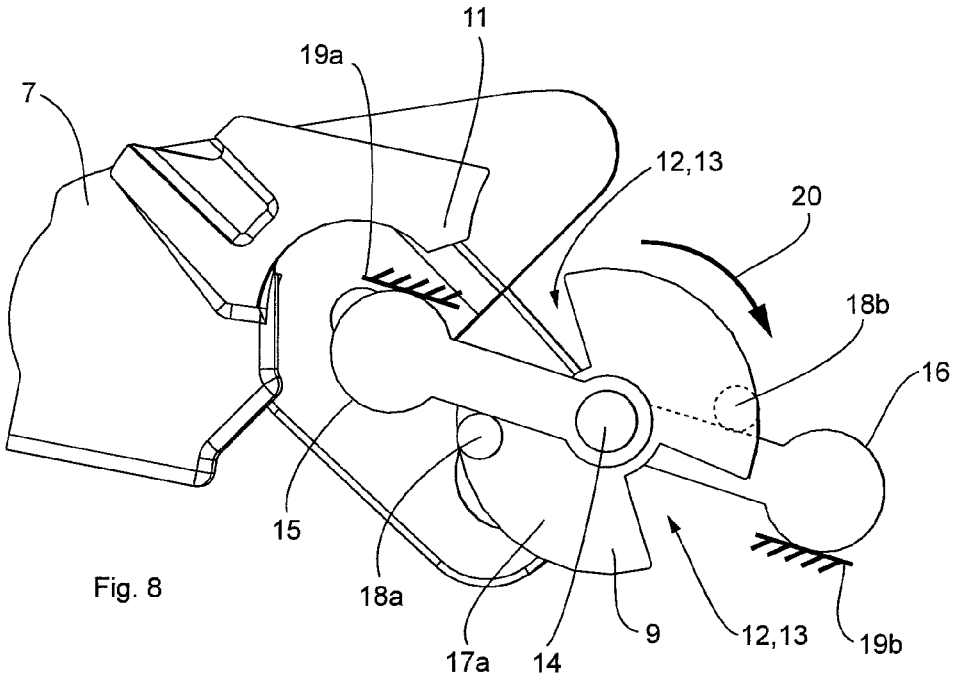

Furthermore, FIG. 6 shows in an exemplary manner that the locking device 8 comprises a first mass element 15 and a second mass element 16, each of which is pivotally mounted with its first longitudinal end 15*a*, 16*a* on the rotational axis, and which can be rotated relative to the retaining element 9. Each of the lever-arm-shaped mass elements 15 and 16 has a center of gravity which is offset toward the rotational axis 14, so that the mass elements 15 and 16 can move from their basic position, which is shown in FIG. 8, to a deflection direction when an accelerating force is applied (for example, as a result of a lateral collision in direction of the interior of the vehicle). This will be explained in more detail in the subsequent description. The lever-arm-shaped mass elements 15 and 16 interact with the retaining element 9. For this purpose, the disc-shaped retaining element 9 has on both lateral surfaces 17*a* and 17*b* a respective projection 18*a* and 18*b*. The projections 18*a* and 18*b* are diametrically arranged at the retaining element 9. However, they are situated on different lateral surfaces 17*a*, 17*b* of the retaining element 9. The retaining element 9 is arranged on the rotational axis 14 between the two mass elements 15 and 16, wherein the mass elements 15, 16 can be rotated about the rotational axis 14 in relation to the retaining element 9. Consequently, the projection 18*a* designed on the lateral surface 17*a* is attached to the first mass element 15, whereas the projection 18*b* designed on the lateral surface 17*b* is attached to the second mass element 16. When because of the inertia of its mass one of the two mass elements 15 and 16 is deflected, it presses against the attached projection 18*a* or 18*b* which is located on the respective lateral surface 17*a*, 17*b* offset to the rotational axis 14, thus rotating the retaining element 9 out of its basic position about the rotational axis 14. In other words: both mass elements 15 and 16 can be rotated about the rotational axis 14 against the rotational direction indicated by the arrow 20. The retaining element 9 is pushed by a mechanical resetting element into the basic position, wherein the resetting element can comprise a spring element which has a force that pushes the retaining element 9 into the basic position and which is applied in direction of the arrow 20 in FIG. 8. In the basic position of the retaining element (see FIG. 8), the lever-arm-shaped mass elements 15 and 16 are situated at the attached projections 18*a* and 18*b* and the movement limitation surfaces 19*a* and 19*b*. The figures show the movement limitation surfaces 19*a* and 19*b* only in exemplary manner and can be designed as part of the handle support 6 or as separate components, wherein by means of the movement limitation surfaces 19*a* and 19*b* the first and the second mass element 15 and 16 can be rotated about the rotational axis 14 only in a predetermined deflection direction.

Subsequently, with reference to FIGS. 7 to 18, the functionality of the invention-based door handle arrangement 3 is described, wherein for reasons of simplicity FIGS. 8, 10, 12, 14, 16 and 18 show only the coupling device 7 and the locking device 9, as well as its different positions which show the functionality.

FIGS. 7 and 8 show the door handle arrangement 3 or the coupling device 7 and the locking device 8 when the handle 4 is not actuated. In non-actuated condition of the handle 4, the retaining element 9 of the locking device 8 is situated in basic position into which the retaining element 9 is pushed by the resetting element. In basic position of the retaining element 9, the projections 18*a* and 18*b* designed on the lateral surfaces 17*a* and 17*b* press the attached mass elements 15 and 16 into their respective basic position in which they are situated at the respective movement limitation surfaces 19*a* and 19*b*, thus blocking a movement of the first and second mass element 15 and 16 against the direction indicated by the arrow 20 in FIG. 8, which corresponds to the deflection direction of the retaining element 9.

Figure 9:
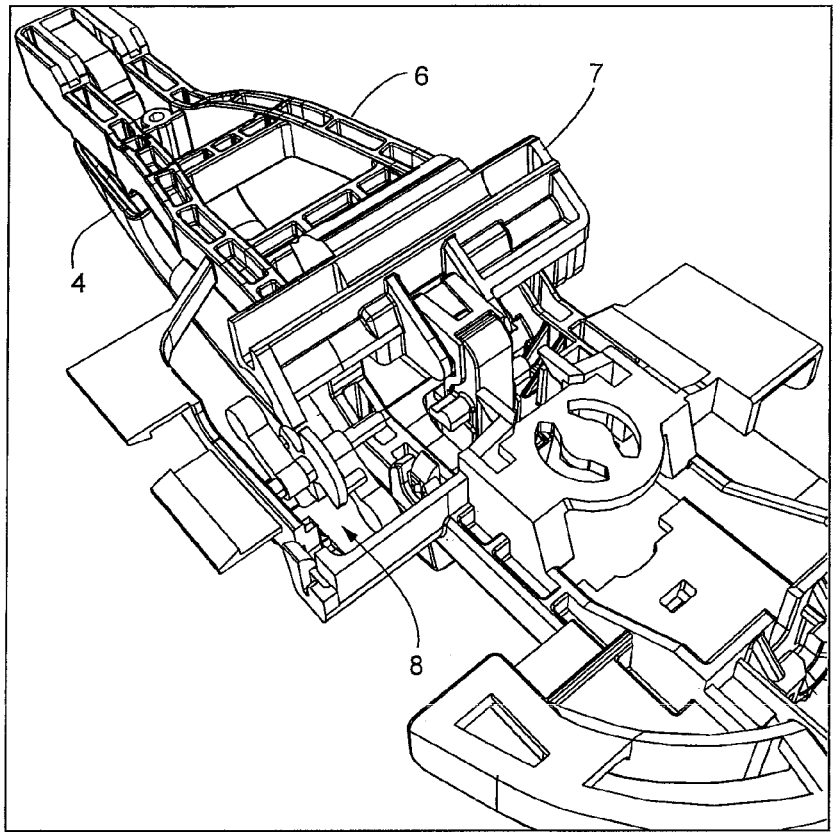
Figure 10:
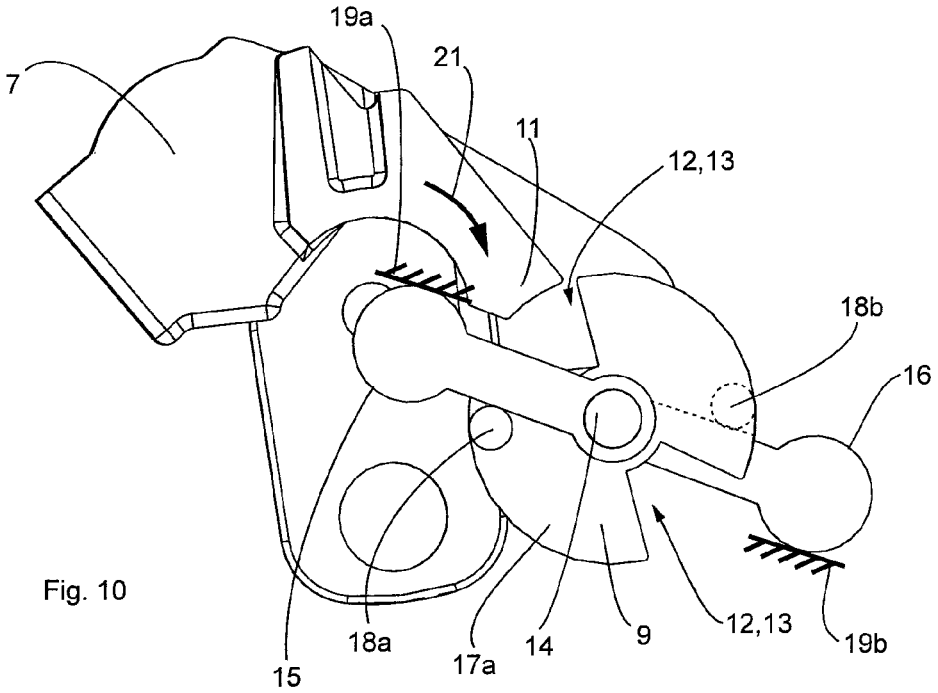

FIGS. 9 and 10 show the door handle arrangement 3 or the coupling device 7 and the locking device 8 with semi-actuated handle 4. The retaining element 9 of the locking device is still situated in basic position, whereas the coupling device 7 motion-linked with the locking device is moving when the handle 4 is semi-actuated. At the same time, the coupling device 7 is pivoted in the direction of the arrow 21 shown in FIG. 10, whereby the motion projection 11 moves in the direction of the slot-shaped recess 12 or the radial groove 13. With semi-actuated handle 4, the coupling device 7 has not been sufficiently deflected to transfer the movement of the handle 4 to the locking system 5, so that the door 2 attached to the locking system 5 is not (yet) opened.

Figure 11:
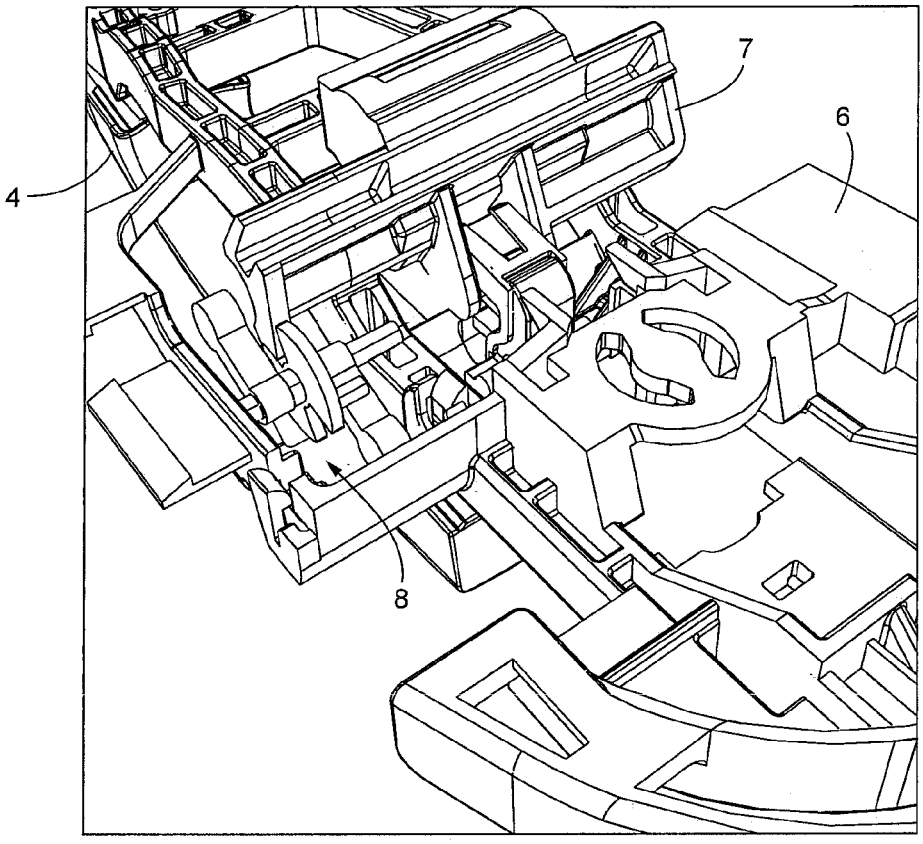
Figure 12:
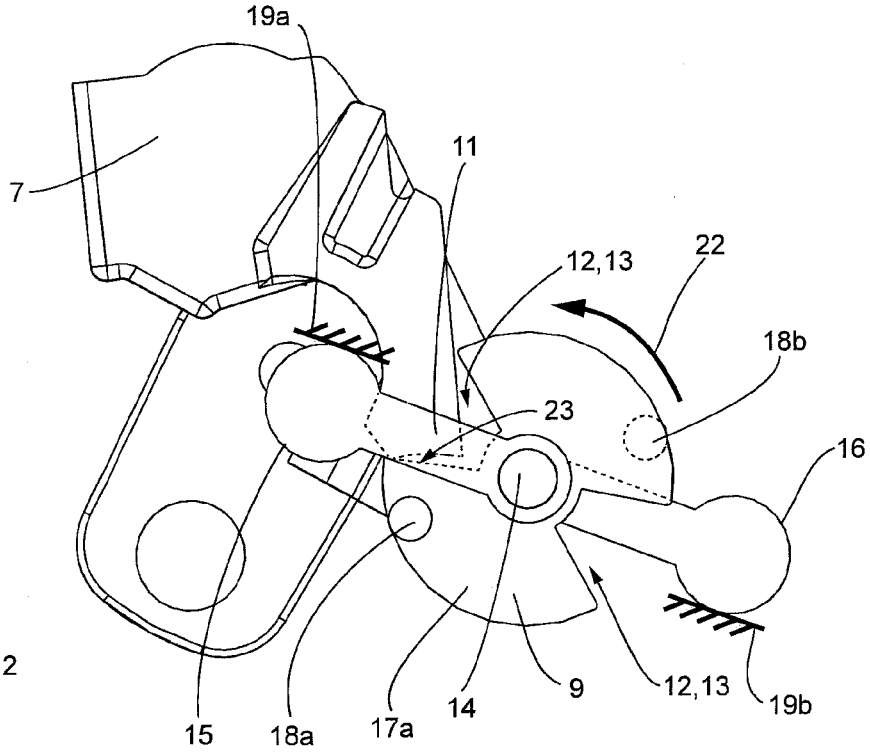

An opening of the door 2 takes only place when the handle 4 is completely actuated. FIGS. 11 and 12 show the door handle arrangement 3 or the coupling device 7 and the locking device 8 when the handle 4 is completely actuated. Even when the handle 4 is completely actuated, both mass elements 15 and 16 are located in their respective basic position, in which they are situated at the attached movement limitation surfaces 19*a* and 19*b*. However, the retaining element 9 is moved out of its basic position in the direction of blockage 22, wherein the movement of the retaining element 9 involves a counter-clockwise rotary motion about the rotational axis 14. The rotary motion of the retaining element 9 is caused by the motion projection 11, which moves down into the slot-shaped recess 12 of the retaining element 9 when the handle is completely actuated and presses against the wall 23 of the slot-shaped recess 12, whereby the retaining element is rotated about the rotational axis 14 in the direction of blockage 22. It has to be noted that a swivel movement of the coupling device 7 as a result of a manual actuation of the handle 4 causes a movement of the retaining element 9 in the direction of blockage without blocking the handle 4 and the coupling device 7. The movement of the retaining element 9 without blocking the deflection of the handle 4 and/or the coupling device 7 maintains the mobility of the locking device 8. In other words: when the coupling device 7 is deflected as a result of the manual actuation of the handle 4, the motion projection 11 is moved into the recess 12 in the retaining element 9, and with further deflecting actuation of the handle, it presses against the wall 23 of the slot-shaped recess 12, whereby the retaining element 9 is pushed in the direction of blockage 22. When the handle 4 has been actuated, the retaining element 9 returns by means of the resetting element to its basic position (see FIG. 8).

Figure 13:
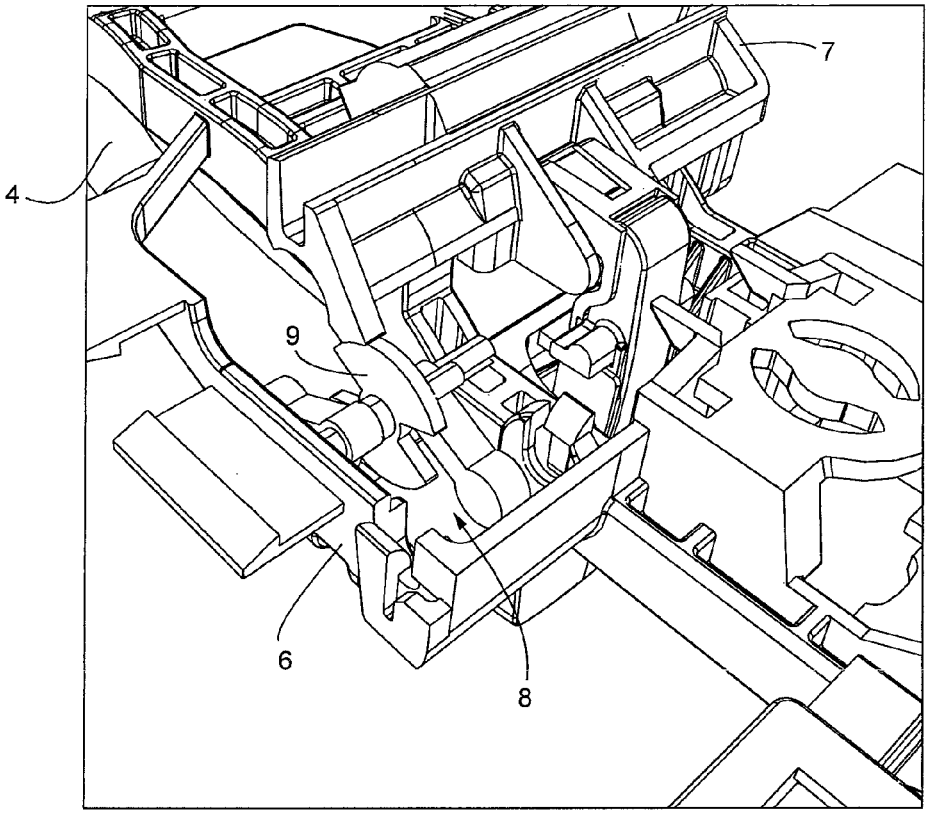
Figure 14:
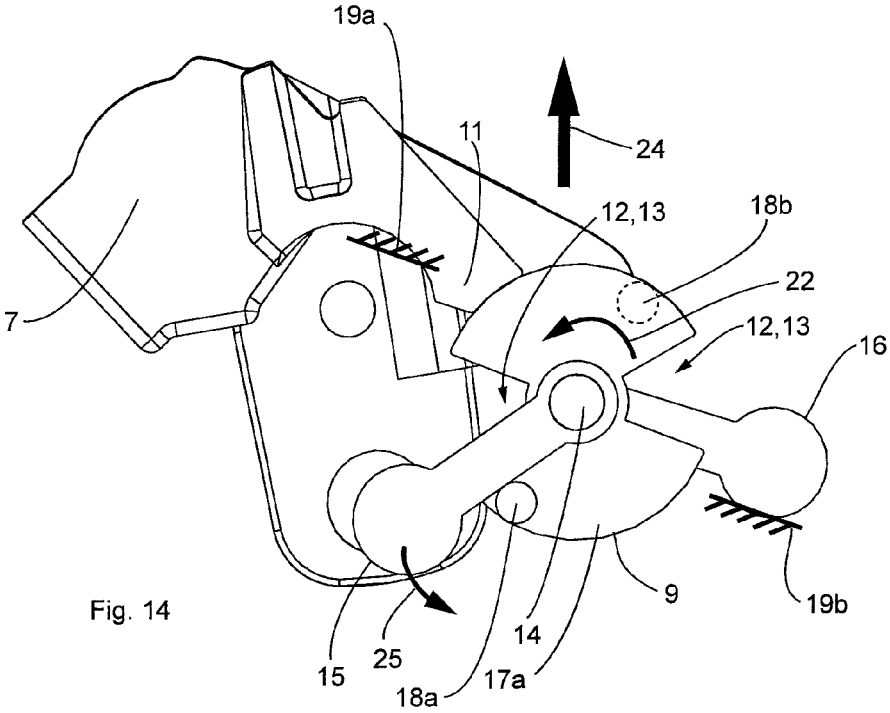

FIGS. 13 and 14 show the door handle arrangement 3 or the coupling device 7 and the locking device 8 when the locking device is activated by an accelerating force applied to the interior space of the vehicle which, accordingly, acts in a first direction 24 (indicated by the arrow in FIG. 14). When the accelerating force is applied to the door handle arrangement 3 as a result of a motor vehicle accident, the retaining element 9 is moved from its basic position, in which it is possible to actuate the handle 4, in the direction of blockage 22, in order to block an actuation of the locking system 5 either by means of the handle 4 or by means of the coupling device 7. The movement of the retaining element 9 by a rotation in the direction of blockage 22 takes place by means of the first mass element 15 which, because of the inertia of its mass when the accelerating force is applied in the first direction 24, is moved from the basic position to a deflection direction 25, wherein the deflection direction 25 involves a clockwise rotational direction about the rotational axis 14. By means of the rotary motion, the first mass element 15 presses against the projection 18*a* formed on the retaining element 9, so that the retaining element is ultimately rotated about the rotational axis 14, thus moving the slot-shaped recess 12 out of the movement path of the motion projection 11. As a result, a complete actuation of the handle 4 and deflection of the coupling device 7 is blocked, because the motion projection 11 can no longer move down into the slot-shaped recess 12, but can only be deflected up to the peripheral edge of the retaining element 9, which represents a blocking surface 27 (see FIG. 6). The deflection direction 25 of the first mass element 15 and the direction of blockage 22 of the retaining element 9 point in the same counter-clockwise direction. Because of the inertia of its mass, the second mass element 16 is attached to the movement limitation surface 19*b*. The second mass element 16 cannot be deflected, so that it is not able to rotate about the rotational axis 14.

Figure 15:
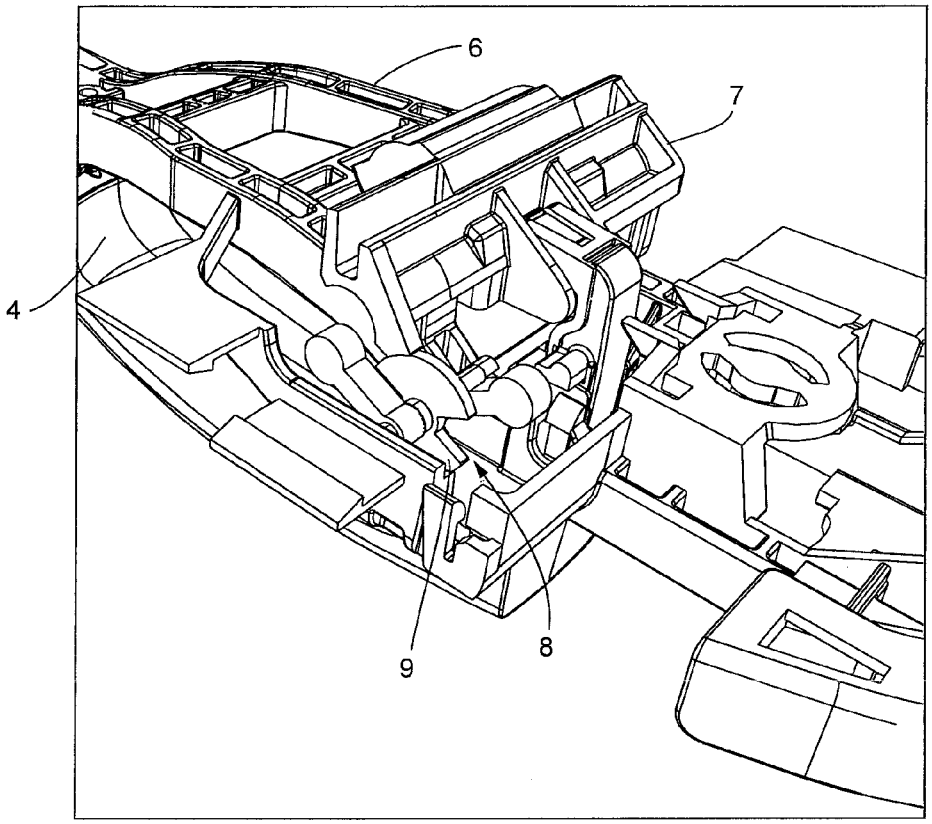
Figure 16:
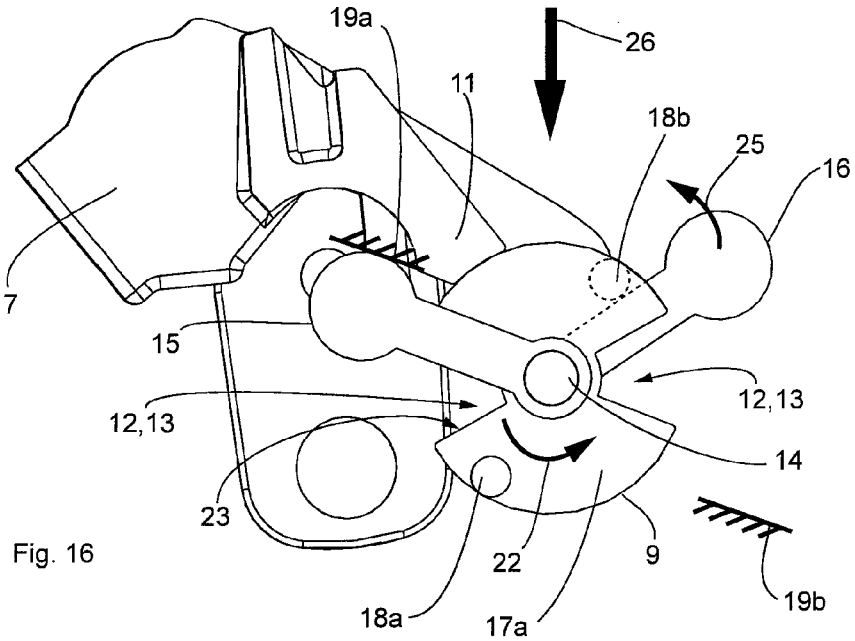

FIGS. 15 and 16 show the door handle arrangement 3 or the coupling device 7 and the locking device 8 in a situation of a motor vehicle accident by which an accelerating force is applied that is directed out of the interior of the vehicle and by which the locking device 8 is activated. In this case, the accelerating force acts in a second direction 26 which is opposite to the first direction 24 (see FIG. 14). Because of the impact in the second direction 26, the first mass element 15 is pressed because of the inertia of its mass against the attached movement limitation surface 19*a* and therefore remains in its basic position. By contrast, the second mass element 16 is moved in the deflection direction 25, which is the same direction as in the situation described in FIG. 14 in which the accelerating force is directed in the first direction 24. During its rotation about the rotational axis 14, the second mass element 16 presses against the projection 18*b*, whereby the retaining element 9 is rotated about the rotational axis 14 in the direction of blockage 22. Consequently, in a motor vehicle accident, the direction of blockage 22 is always the same, regardless of whether the accelerating force is applied in the first or second direction. As indicated in the situation shown in FIG. 14, the deflection direction 25 is identical with the direction of blockage 22, and thus in counter-clockwise direction. Consequently, when an accelerating force is applied in the second direction, the second lever-arm-shaped mass element 16 can be moved from the basic position into the same deflection direction 25 as the first mass element 15. As soon as no accelerating force is applied, the retaining element 9 is again pushed back into the basic position by means of the resetting element, whereby the projection 18*b* is pressed against the second mass element 16 and thus the mass element returns to the basic position.

Figure 17:
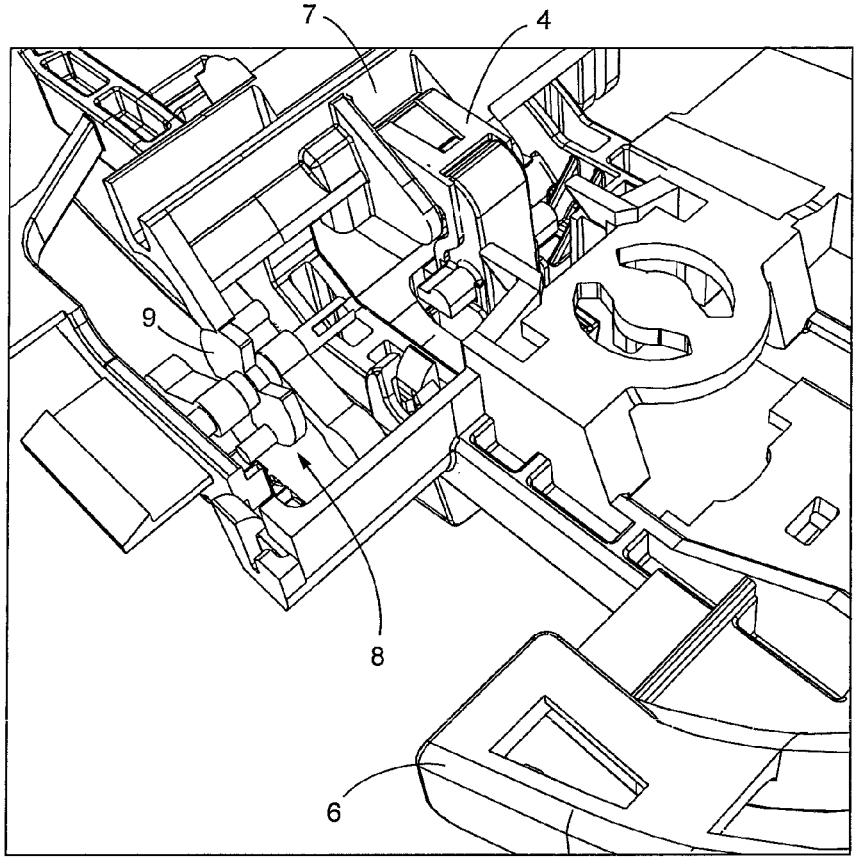
Figure 18:
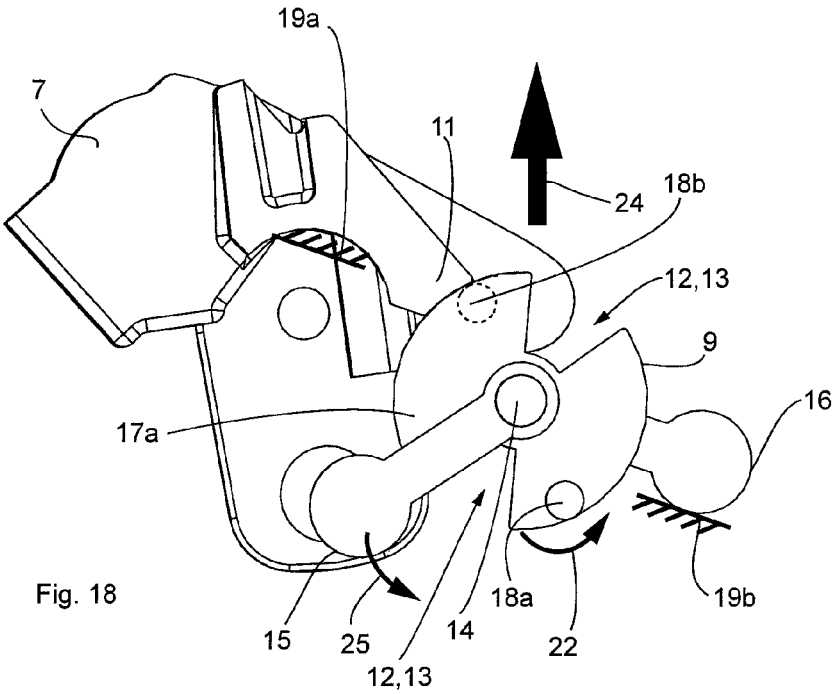

FIGS. 17 and 18 show an overtorque of the retaining element 9 in the event of a collision. More precisely, these figures show a situation in which the locking device 8 is activated and the retaining element 9 is rotated in such a way that none of the two mass elements 15, 16 is attached to the projections 18*a*, 18*b*. As in the situations shown in FIGS. 13 and 14, also in the condition of overtorque shown in FIGS. 17 and 18, an accelerating force resulting from a motor vehicle accident is applied into the interior of the vehicle, or in a first direction 24. In the case shown in FIGS. 17 and 18, the accelerating force is so strong that the first mass element 15 accelerates the projection 18*a* to the extent that the mass element 15 reaches its end position prior to the projection 18*a* and the retaining element 9 continues to rotate, which represents in the case shown an overtorqued end position in which the first mass element 15 is not attached at the projection 18*a*.

In summary, the present invention provides a door handle arrangement 3 with a non-locking locking device 8 which is characterized by a secure activation and which securely blocks the handle 4 or the coupling device 7 even when accelerating forces result in oscillation or fluttering processes. According to the invention, the locking device 8 can be attached and actuated on both sides of the vehicle. As a result, the locking device can be used on both sides of the vehicle. According to the invention, the locking device 8 is always activated by a movement of the retaining element 9 in the same direction, regardless of the direction in which the accelerating force is applied. This is achieved by means of the specifically designed locking device 8, which comprises the retaining element 9, which, for example, can be designed in the shape of a butterfly, and the two mass elements 15, 16. The retaining element 9 and the mass elements 15, 16 are mounted on the mutual rotational axis 14, wherein the retaining element 9 is arranged between the two mass elements 15, 16. The mass elements 15, 16 can be rotated in relation to one another and in relation to the retaining element 9. Because of the inertia of their mass, the two mass elements 15, 16 can move in one direction, which is opposite to the direction of acceleration. At the same time, the movement limitation surfaces 19*a*, 19*b* restrict the movement of both mass elements 15, 16 and allow only for a movement in one direction. This releasing movement of the mass elements 15, 16 involves a rotary motion about the rotational axis 14, so that the mass elements 15, 16 always rotate in the particular direction of blockage 22, regardless of the direction of the applied accelerating force. When one of the two mass elements 15, 16 is moved as a result of an accelerating force, the respective mass element is pressed against the attached projection 18*a*, 18*b*, whereby the retaining element 9 is rotated in the direction of blockage about the rotational axis 14.

According to the embodiment shown, the rotational axis 14 of the locking deice 8 extends basically parallel to the swivel axis of the coupling device 7. To ensure the mobility of the locking device 8 and thus prevent the locking device from getting stuck, the motion projection 11 of the coupling device 7 is moved into the recess 12 of the retaining element 9 and rotates the retaining element during normal manual actuation of the handle 4, thus ensuring the mobility of the locking device 8. In the locking device 8 that can be used on both sides and that is designed as a mass lock, both mass elements 15, 16 can consist of die-cast zinc, whereas the retaining element 9 can be produced from plastic material (for example, POM) which has high stability, strength and stiffness.

Naturally, the previously described invention is not restricted to the embodiment described and demonstrated. It is obvious that the embodiment shown in the drawing can be altered in numerous ways according to the applications intended by an expert, without leaving the scope of the invention. At the same time, the invention includes everything that is contained in the description and/or in the drawing, including any obvious ideas an expert has in addition to the concrete embodiment.

The invention claimed is:

1. A door handle arrangement for a motor vehicle, the door handle arrangement comprising:

a frame-like handle support, a manually actuated handle which is pivotally mounted at the handle support so that a user is able to open a door or flap of the motor vehicle, a swivel-mounted coupling device, by means of which a movement of the handle is transferred to an on-board locking system in order to release the door or flap for opening, and a locking device with a retaining element wherein the locking device is used as a mass lock and is movably attached to the handle support, the retaining element being pivotally mounted to the handle support on a rotational axis, wherein, when an accelerating force is applied in a first direction as a result of a motor vehicle accident, the retaining element is designed to pivotally move around the rotational axis from a basic position, in which it is possible to actuate the handle, into a blockage direction in which an actuation of the locking system by the handle and/or the coupling device is blocked by the retaining element, and wherein the retaining element is designed to pivotally move around the rotational axis from the basic position into the blockage direction when as a result of the motor vehicle accident an accelerating force is applied in a second direction that is opposite to the first direction, wherein the blockage direction is the same regardless of whether the accelerating force is applied in the first direction or the second direction.

2. A door handle arrangement according to claim 1, wherein a swivel movement of the coupling device resulting from a manual actuation of the handle causes a movement of the retaining element in the blockage direction without blocking the handle and/or the coupling device.

3. A door handle arrangement according to claim 1, wherein the locking device comprises a first lever-arm-shaped mass element which because of the inertia of its mass can be moved from a basic position in a deflection direction when an accelerating force is applied in the first direction, and a second lever-arm-shaped mass element which because of the inertia of its mass can be moved from a basic position in the same deflection direction as the first mass element when an accelerating force is applied in the second direction.

4. A door handle arrangement according to claim 3, wherein the retaining element has a disc-shaped design, wherein each of the two lateral surfaces of the retaining element has at least one projection, and the projections are arranged diametrically, and wherein a respective projection is attached to a respective mass element, which is designed and attached in such a way that it presses during movement in deflection direction against the attached projection and pushes together with the retaining element in the particular direction of blockage.

5. A door handle arrangement according to claim 3, wherein the first mass element and the second mass element are attached in the respective basic position to a movement limitation surface which blocks a movement of the first and second mass element in a direction that is opposite to the deflection direction.

6. A door handle arrangement according to claim 5, wherein a respective first longitudinal end of the lever-arm-shaped mass elements is pivotally mounted on a rotational axis, wherein the retaining element is pivotally mounted by means of the rotational axis at the handle support and on the rotational axis between the first mass element and the second mass element.

7. A door handle arrangement according to claim 1, wherein the coupling device is provided with a motion projection which moves down into a slot-shaped recess of the retaining element when the coupling device is pivoted as a result of a manual actuation of the handle, wherein upon further deflecting actuation of the handle the motion projection is pressed against the wall of the slot-shaped recess and pushes the retaining element into the particular direction of blockage.

8. A door handle arrangement according to claim 7, wherein the slot-shaped recess formed in the retaining element is designed as a radially extending groove into which the motion projection of the coupling device is able to pivot.

9. A door handle arrangement according to claim 8, wherein the retaining element has at least one radially extending groove, preferably two grooves arranged in diametrical fashion.

10. A door handle arrangement according to claim 1, wherein a mechanical resetting element is provided which has a force that can push the retaining element into the basic position.

11. A door handle arrangement according to claim 1, wherein the retaining element is disc-shaped.

* * * * *